United States Patent [19]

Greilinger et al.

[11] Patent Number: 4,559,990

[45] Date of Patent: Dec. 24, 1985

[54] CONTINUOUS CASTING AND ROLLING DEVICE

[75] Inventors: Friedrich Greilinger, Aachen; Ulrich Katschinski, Mülheim-Heissen, both of Fed. Rep. of Germany

[73] Assignee: Fried. Krupp Gesellschaft mit beschränkter Haftung, Essen, Fed. Rep. of Germany

[21] Appl. No.: 599,746

[22] Filed: Apr. 11, 1984

[30] Foreign Application Priority Data

Apr. 14, 1983 [DE] Fed. Rep. of Germany ..... 3313542

[51] Int. Cl.[4] ..... B22D 11/128

[52] U.S. Cl. ..... 164/428; 164/448; 425/367

[58] Field of Search ..... 164/428, 447, 448; 425/363, 367

[56] References Cited

U.S. PATENT DOCUMENTS

| | | | |
|---|---|---|---|
| 2,693,012 | 11/1954 | Harris et al. | 164/428 |
| 3,552,172 | 1/1971 | Hamacher | 72/249 |
| 4,156,453 | 5/1979 | Scheinecker | 164/448 |
| 4,372,736 | 2/1983 | Gooch et al. | 425/367 |

FOREIGN PATENT DOCUMENTS

| | | |
|---|---|---|
| 209510 | 6/1980 | Austria . |
| 58-23553 | 2/1983 | Japan . |
| 58-29552 | 2/1983 | Japan . |

*Primary Examiner*—Lowell A. Larson
*Assistant Examiner*—Jorji M. Griffin
*Attorney, Agent, or Firm*—Spencer & Frank

[57] ABSTRACT

A continuous casting and rolling device of the type in which molten metal is introduced, by a nozzle, between a pair of liquid cooled rolls which are supported in a roll supporting structure and which each have a coolant connection and a drive which are disposed on different sides or ends of the roll supporting structure. Each roll is equipped with its own geared motor which is releasably fastened to the respective roll pin as a freely projecting drive unit.

8 Claims, 4 Drawing Figures

CONTINUOUS CASTING AND ROLLING DEVICE

BACKGROUND OF THE INVENTION

The present invention relates to a continuous casting and rolling device including a pair of liquid cooled rolls between which molten metal is introduced by means of a nozzle and whose coolant connection and drive are disposed on different sides of the roll supporting structure.

Continuous casting and rolling devices of the above mentioned type are disclosed, for example, in Austrian Pat. No. 209,510 and are equipped with a synchronous drive which operates by means of articulated shafts and includes either a distributor drive or two individual drives which are synchronized by means of angular gears. In order to avoid kinematic irregularities, toothed spindles are frequently used as drive shafts. Such toothed spindles are relatively expensive. Since a synchronous drive, which moreover requires a considerable amount of space, can be disassembled only at considerable expenditure of labor and time, the known continuous casting and rolling devices are designed so that an exchange of rolls can be effected only from the side where the coolant is connected. A further significant drawback of the prior art continuous casting devices is that, due to the use of the synchronous drive, the roll diameters must not differ from one another more than slightly so as to avoid differences in rolling circumference. The result is that rolls that may still be usable must be reground, thus unnecessarily shortening their realizable service life.

SUMMARY OF THE INVENTION

It is the object of the present invention to improve the manipulation of continuous casting and rolling devices of the above mentioned type under justifiable expenditures. In particular, the amount of labor and time required for the exchange of rolls is to be reduced and the economy of operation of the device is to be increased by improved adaptability to different operating conditions.

The above object is achieved according to the present invention by a continuous casting and rolling device of the type wherein molten metal is introduced between adjacent rolls by means of a nozzle, and which essentially comprises a pair of juxtaposed liquid cooled rolls rotatably mounted in a roll supporting structure with each of the rolls having a respective roll pin extending from one end at one side of the roll supporting structure; a respective coolant connection for each of the rolls disposed on the opposite side of the roll supporting structure; a respective geared motor for each of the rolls; and respective means for releasably fastening each of the geared motors to a respective one of the roll pins as a freely projecting drive unit.

The basic idea of the invention is thus to equip each roll with a direct roll drive in the form of a geared motor associated only with the respective roll and releasably fastened to the respective roll pin as a freely projecting drive unit. The use of such compact and independent geared motors have the advantage that compensation for any differences in the diameter of the rolls can be achieved by means of the drive unit and, moreover, the torque distribution between the rolls, particularly so as to influence the surface of the casting, can be freely set. Any exchange of rolls which may be required can be effected quickly, on the one hand, by loosening the complete drive unit, which moreover has a relatively short longitudinal extent, without requiring the complicated disassembly of the liquid cooling system as in the prior art devices. Moreover, since the rolls simultaneously form a compact unit with the releasably fastened drive units, disassembly of the rolls can be effected by removing the entire compact unit without disconnection of the respective drive unit from the roll. A change of rolls in this manner requires only that a further compact unit, comprising a roll and a drive unit, be available.

Advisably, according to a feature of the invention, the device according to the present invention is equipped in such a manner that the housing of one of the geared motors, particularly the lower of the two geared motor, is held secure against rotation at the roll supporting stand and is in articulated communication by means of a torque moment transmitting support with the housing of the other geared motor. This has the advantage that the roll alignment can be changed without having to intrude in the structure of the geared motors.

The torque transmitting support can be realized, in particular, in that the housings of both geared motors are equipped with a supporting arm and are in communication with one another by means of a respectively articulated guide arm.

In a particularly compact configuration of the present invention, each geared motor is equipped with a flange mounted planetary gearing drive whose driven output shaft forms a torque transmitting connection with the roll pin of the associated roll, with such connection being estabished by axial displacement. Thus, for an exchange of rolls, the geared motors can be released from the rolls by a simple pulling movement and can be deposited at a suitable location.

According to still a further feature of the invention, a particulary simple and quickly established axial connection between the driven shaft of the geared motor and the roll pin comprises a clamping ring which passes over the respective connection sections and which is made, in particular, of two articulatedly connected ring halves that serve as a closing element with a clamping screw passing through them. In this case, the axial connection can be released by releasing a single clamping screw and moving apart the two portions of the clamping ring. The abutting connection sections of the roll pin, on one side, and of the associated geared motor, on the other side, preferably form a trapezoidal profiled cross section which rests in an adapted recess of the clamping ring.

However, the device according to the invention may also be designed so that the clamping ring is made of a plurality of partial rings which, in order to establish the axial connection, are clamped together in the axial direction between the geared motors and the roll pins. The juxtaposed connection sections may here also form a different profile, for example a rectangular profile.

Preferably, the axial connection between each geared motor and its associated roll pin is further designed so that the driven shaft of the geared motor is supported on a circumferential face of the roll pin. The driven shaft thus passes over a portion of the roll pin.

BRIEF DESCRIPTION OF THE DRAWINGS

The present invention will be described in greater detail below with the aid of embodiments which are shown in the drawing in very schematic views wherein.

DETAILED DESCRIPTION OF THE PREFERRED EMBODIMENTS

Figure 1:
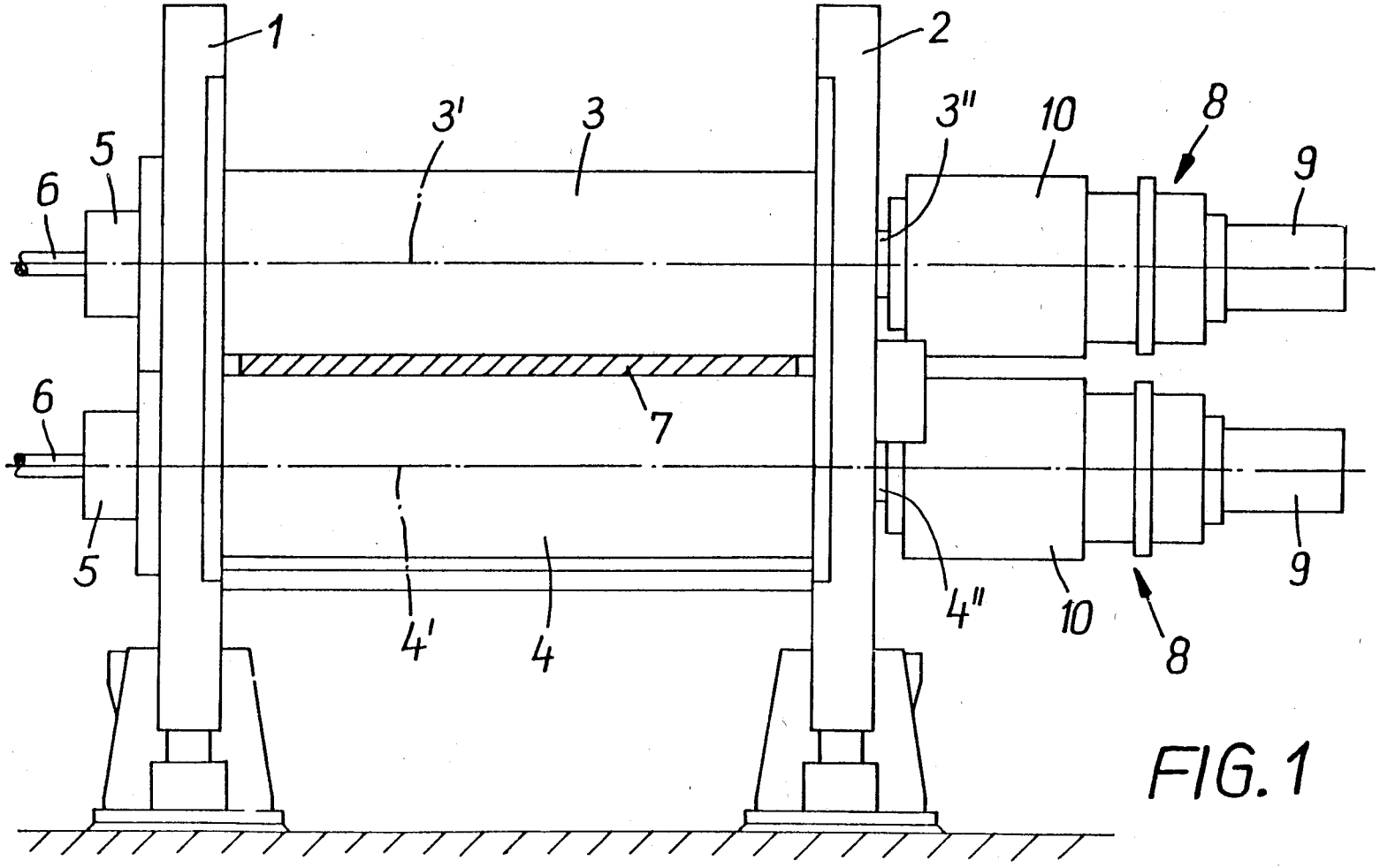
FIG. 1 is a frontal view of a continuous casting and rolling device according to the invention which is equipped with two independent, freely projecting drive units for the two cooperating rolls.

Referring now to FIG. 1, there is shown a continuous casting and rolling device including a roll supporting structure comprising generally vertically extending stands 1 and 2 which rotatably hold two superposed, adjustable and removable liquid cooled rolls 3 and 4. Each roll 3, 4 is equipped, in a conventional manner, with a coolant connection 5 at one end, (on the left of the stand 1 of the roll supporting structure in FIG. 1), through which coolant conducted in a suitable conduit system 6 is introduced into the respective roll and returned to the outside for recooling.

A sufficiently designed cooling system for rolls 3 and 4 assures that the molten metal introduced through a nozzle (not shown) is solidified before it passes through the point of least separation between the two rolls 3 and 4 (i.e. the connecting line between their axes of rotation 3' and 4'). The cast product which is completely solidified in the region of the shortest distance between the two rolls 3 and 4 is marked with the reference numeral 7.

Figures 3, 4:
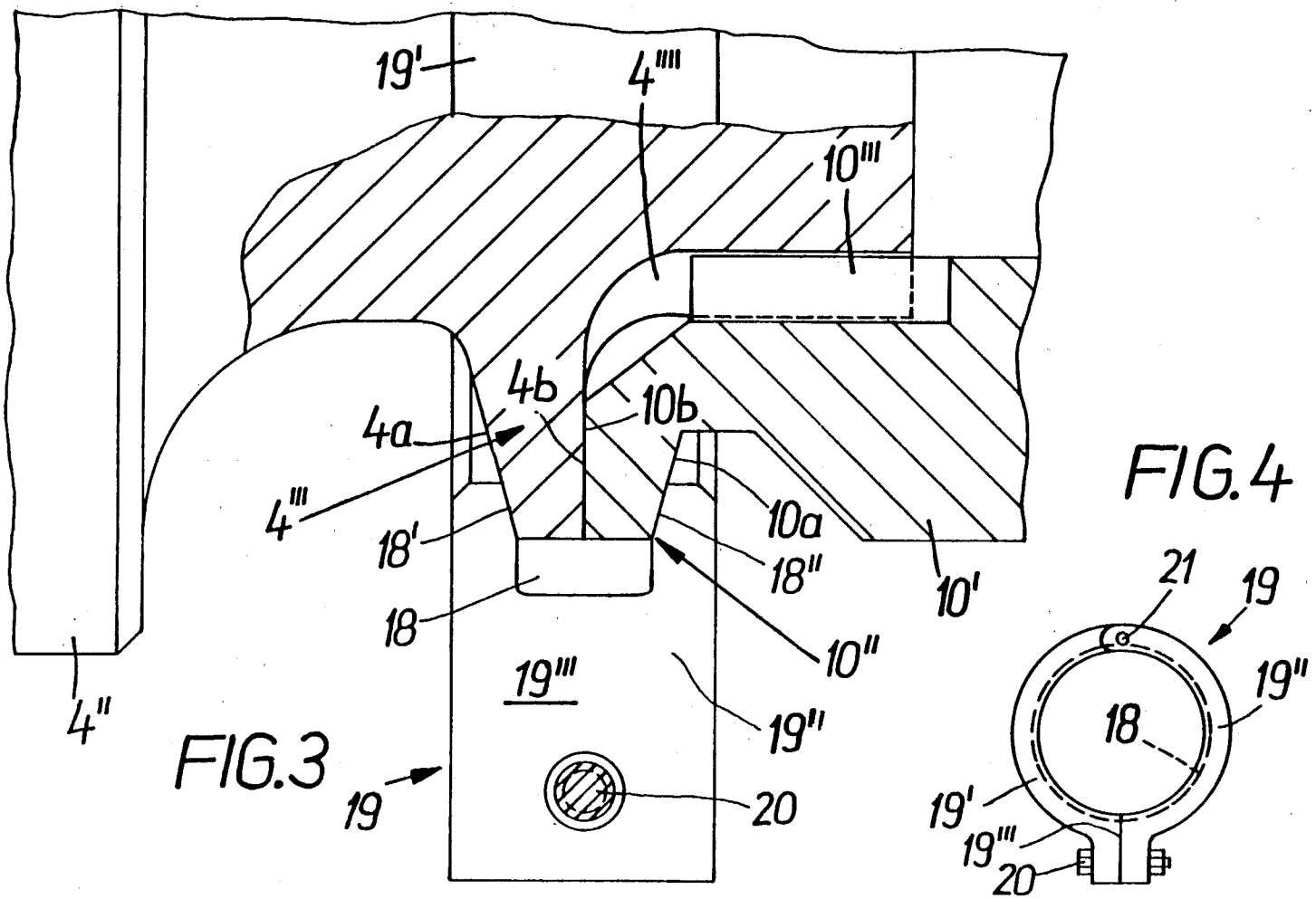
FIG. 3 is a partial view, partially in section, in the area of the connection between a roll pin and the associated driven shaft of a drive unit.
FIG. 4 is a view of a clamping ring, to a smaller scale than in FIG. 3, with which the axial connection is established between the roll pin and the driven shaft.

On the side of the roll supporting structure opposite the coolant connection 5, i.e., adjacent the stand 2, roll pins 3" and 4" of the rolls 3 and 4 respectively are each in releasable communication with their own respective direct drive in the form of a geared motor 8, each preferably comprising a hydraulic motor 9 and a flange or axially mounted planetary gearing drive 10 having a driven output shaft 10' (FIG. 3).

Due to the use of the planetary gearing drives 10, the drive motors 8 are of compact design and project freely beyond stand 2, and thus can be removed without difficulty from the associated roll pins 3" and 4", respectively, so that an exchange of rolls, if it becomes necessary, can be effected from the side of stand 2, i.e. without disassembly of the water cooling system.

Figure 2:
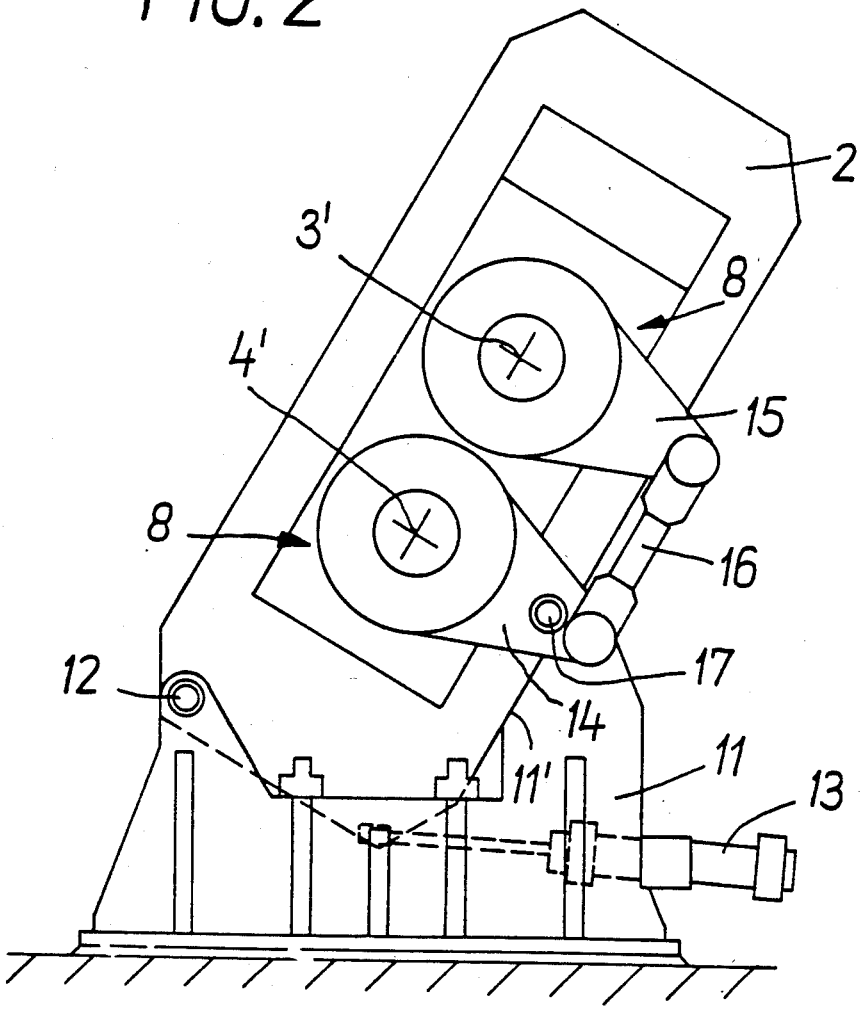
FIG. 2 is a side view of the roll supporting structure of FIG. 1 in the operating position with drive units which are in communication with one another by means of a torque transmitting support.

In the operating position shown in FIG. 2, the roll supporting structure, including at least stands 1 and 2 and the rolls 3, 4, takes on a position which is inclined by 30° with respect to the vertical and in which it is supported at the abutment face 11' of a console 11. Pivoting into and out of the illustrated operating position is effected, after release or loosening of a fastening bolt 12, by means of a pivot drive 13 which includes at least one hydraulic cylinder.

In the vicinity of the roll supporting structure, i.e. in the vicinity of stand 2 as shown, the respective housings of the superposed geared motors 8 are each equipped with a laterally extending supporting arm 14 or 15, respectively, and, through the intermediary of these supporting arms, are articulated with one another by means of a guide arm 16. In contradistinction to the upper supporting arm 15, the lower supporting arm 14 is rotatably held by means of a bolt 17 fastened to stand 2. Supporting arms 14 and 15 together with guide arm 16, which is connected to each arms 14 and 15 in an articulated manner, form a torque transmitting support which permits changes in the adjustment of the rolls 3 and 4 without further structural interference.

In order for each geared motor 8 to be connected with the associated roll pin (for example, roll pin 4") without particular difficulty, as shown in FIG. 3 the members to be connected together, i.e. roll pin 4" and driven output shaft 10' of the planetary gearing drive 10, are each provided with connection sections or radially extending flanges 4''' and 10", respectively, which in the connection position shown in FIG. 3 have a cross sectional profile in the form of a trapezoid with outer inclined surfaces 4*a* and 10*a*, respectively. The associated contact surfaces of members 4" and 10', which are axially supported against one another in the illustrated connection position, are marked 4*b* and 10*b*, respectively.

The trapezoidal cross-sectional profile of engaging members 4''' and 10" engages, by means of its sloped outer flanks 4*a* and 10*a*, into a matching recess 18 of a clamping ring 19 which, when secured by means of a clamping screw 20, keeps contact surfaces 4*b* and 10*b* in contact with one another.

As shown in FIG. 4, clamping ring 19 includes two ring halves 19' and 19" which are movably connected together by means of an articulated bolt 21 on the side opposite clamping screw 20. By tightening clamping screw 20, the outer sides 4*a* and 10*a* are brought in contact with the correspondingly sloped recess surfaces 18' and 18" so that contact surfaces 4*b* and 10*b* of members 4" and 10' are immovably supported against one another in the axial direction. The abutment surfaces of ring halves 19' and 19", which are moved against one another under the influence of clamping screw 20, are marked 19'''.

The torque transmitting connection between roll pin 4" and driven shaft 10' includes axially extending teeth or splines 4'''' which are formed about the periphery of the end of the roll pin 4" and which mesh with teeth or splines 10''' formed in the interior peripheral surface of an axial recess formed in the end of the driven shaft 10', and into which the end of roll pin 4" extends. Teeth or splines 4'''' of roll pin 4" simultaneously serve as a circumferential surface on which drive shaft 10' of the associated geared motor 8 is supported.

The advantage of the embodiment shown in FIG. 3 and FIG. 4 is that it is merely necessary to actuate a single clamping screw 20 to release drive shaft 10', and thus geared motor 8, from roll pin 4".

Seen as a whole, the present invention considerably improves the economy of operation of continuous casting and rolling devices since the expenditures for the exchange of rolls have been reduced significantly and, as a result of the use of independent direct drives, rolls having different diameters can also be used. Moreover, the use of direct drives results not only in a reduction of space requirements but also makes superfluous the use of special, expensive drive shafts. It is of additional and significant importance that the rolls form respective independent, compact units with the drive units which, if required, can be manipulated as such, i.e. without separating the drive unit from the roll.

Instead of bolt 17 shown in FIG. 2, a different type of rotationally secure connection can be used between supporting arm 14 and stand 2. In particular, supporting arm 14 may be held on stand 2 by means of abutments.

It will be understood that the above description of the present invention is susceptible to various modifications, changes and adaptations, and the same are intended to be comprehended within the meaning and range of equivalents of the appended claims.

What is claimed is:

1. A continuous casting and rolling device of the type wherein molten metal is introduced between adjacent rolls by means of a nozzle comprising:

a pair of juxtaposed liquid cooled rolls rotatably mounted in a roll supporting structure with each of said rolls having a respective roll pin extending from one end at one side of said roll supporting structure; a respective coolant connection for each of said rolls disposed on the opposite side of said roll supporting structure; a respective geared motor for each of said rolls; respective means for releasably fastening each of said geared motors to a respective one of said roll pins as a freely projecting drive unit; means for securing the housing of one of said geared motors against rotation to said roll supporting structure; and a torque transmitting support means for connecting said housing of said one of said geared motors in articulated communication with the housing of the other of said geared motors.

2. A device as defined in claim 1 wherein: each of said housings of said geared motors has a laterally extending support arm; said means for securing the housing of one of said motors includes a bolt fastening said support arm of said housing of said one of said geared motors to said roll supporting structure; and said torque transmitting support means includes a guide arm articulated to each of said support arms.

3. A device as defined in claim 1 wherein: each of said geared motors includes a motor with a flange mounted planetary gearing drive having a driven output shaft; and each said means for releasably fastening includes means for forming a torque transmitting connection between a respective said driven output shaft and a respective said roll pin, with said torque transmitting connection being established by axial displacement of said shaft relative to said pin.

4. A device as defined in claim 3 wherein each said means for releasably fastening further includes means for forming an axial connection between a respective one of said driven shafts and a respective one of said roll pins comprising a respective radially extending flange on said roll pin and on said driven shaft, and a clamping ring which jointly encloses the respective radially extending flanges of one of said roll pins and one of said driven shafts.

5. A device as defined in claim 4 wherein: said laterally extending flanges of each said means for forming an axial connection abut one another with said flanges having a shape such that the abutting said flanges form a trapezoidal cross-sectional profile; and said clamping ring includes a recess which is shaped to matingly engage said trapezoidal profile.

6. A device as defined in claim 5 wherein said clamping ring comprises two ring halves which are articulated at one end and which are connected together at their other ends by a clamping screw which acts as a releasable closing element.

7. A device as defined in claim 3 wherein each of said driven shafts is supported on a circumferential surface of a respective one of said roll pins.

8. A device as defined in claim 3 wherein said means for forming a torque transmitting connection includes: a plurality of axially extending teeth formed on the circumferential surface of said roll pin adjacent the end thereof; and an axial bore formed in the end surface of said driven shaft, with said bore having a plurality of axially extending teeth which matingly engage with said teeth on said roll pin when said end of said roll pin is inserted in said bore.

* * * * *